US009911289B2

(12) United States Patent
Ting et al.

(10) Patent No.: US 9,911,289 B2
(45) Date of Patent: Mar. 6, 2018

(54) CASH DRAWER

(71) Applicant: NCR Corporation, Duluth, GA (US)

(72) Inventors: Orson Ting, Cebu (PH); Alvin Besinga, Tagbilaran (PH); Ronald Allan Rodriguez, Lapu-Lapu (PH); Michael Duka Pacaña, Lapu-Lapu (PH)

(73) Assignee: NCR Corporation, Atlanta, GA (US)

( * ) Notice: Subject to any disclaimer, the term of this patent is extended or adjusted under 35 U.S.C. 154(b) by 203 days.

(21) Appl. No.: 14/291,041

(22) Filed: May 30, 2014

(65) Prior Publication Data

US 2015/0348376 A1 Dec. 3, 2015

(51) Int. Cl.
*G07G 1/00* (2006.01)

(52) U.S. Cl.
CPC ..... *G07G 1/0027* (2013.01)

(58) Field of Classification Search
USPC ..... 235/7 R
See application file for complete search history.

(56) References Cited

U.S. PATENT DOCUMENTS

| | | | | | |
|---|---|---|---|---|---|
| 4,786,785 | A * | 11/1988 | Felt | G07G 1/0027 | 206/0.83 |
| 5,451,753 | A * | 9/1995 | Leatherwood | G07G 1/0027 | 235/10 |
| 5,615,624 | A * | 4/1997 | Terry | E05G 7/008 | 109/19 |
| 2003/0136825 | A1* | 7/2003 | Bletzinger | G07G 1/0027 | 235/7 R |
| 2009/0045030 | A1* | 2/2009 | Peart | G07G 1/0027 | 194/206 |
| 2010/0180804 | A1* | 7/2010 | Czarnecki | A45C 1/10 | 109/45 |

* cited by examiner

*Primary Examiner* — Michael G Lee
*Assistant Examiner* — David Tardif
(74) *Attorney, Agent, or Firm* — Paul W. Martin

(57) ABSTRACT

A cash drawer with an ergonomic design. In an example embodiment, the cash drawer includes a housing having an operator side, and a drawer assembly moveable from a closed position in the housing to an open position. The drawer assembly includes a drawer, a first tray in the drawer for storing bank notes, and a second tray in the first tray for storing coins. The cash drawer additional stores a removable lid with a handle. The lid includes a first side for enclosing the first tray and a second side for enclosing the second tray, thus forming a suitcase for transporting the bank notes and coins.

12 Claims, 11 Drawing Sheets

CASH DRAWER

BACKGROUND

This present invention relates to point-of-sale peripherals and more specifically to a cash drawer.

Conventional cash drawers include a till containing compartments for storing different denominations of bank notes and coins. The till is typically removable. Tills may be removed for counting and reconciliation, for example, during employee shift changes.

Current cash drawers are not sufficiently ergonomic for all environments. Conventional cash drawer length often requires cashiers to step back when the drawer is fully opened. The bank note compartments are defined by front walls which are square to the bottom surface of the till, making removal of bills difficult. Also, conventional cash drawer tills require a separate lockable lid to be affixed to the tills when removed.

Therefore, it would be desirable to provide an improved cash drawer.

SUMMARY

In accordance with the teachings of the present invention, a cash drawer is provided.

In an example embodiment, the cash drawer includes a housing having an operator side, and a drawer assembly moveable from a closed position in the housing to an open position. The drawer assembly includes a drawer, a first tray in the drawer for storing bank notes, and a second tray in the first tray for storing coins.

BRIEF DESCRIPTION OF THE DRAWINGS

The present invention may take form in various components and arrangement of components and in various methods. The drawings are only for purposes of illustrating example embodiments and alternatives and are not to be construed as limiting the invention.

DETAILED DESCRIPTION

Figure 1:
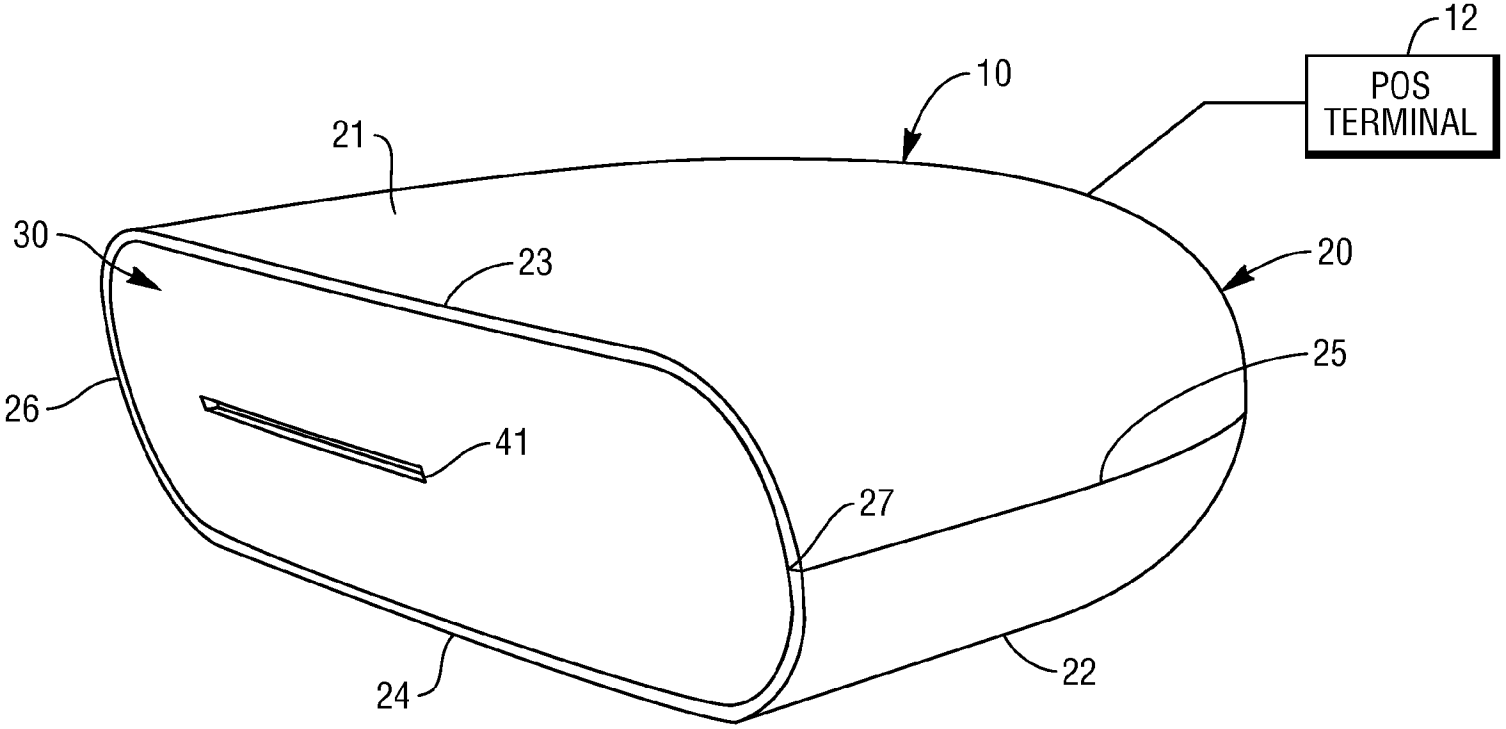
FIG. 1 is a perspective view of an example cash drawer.
Figure 2:
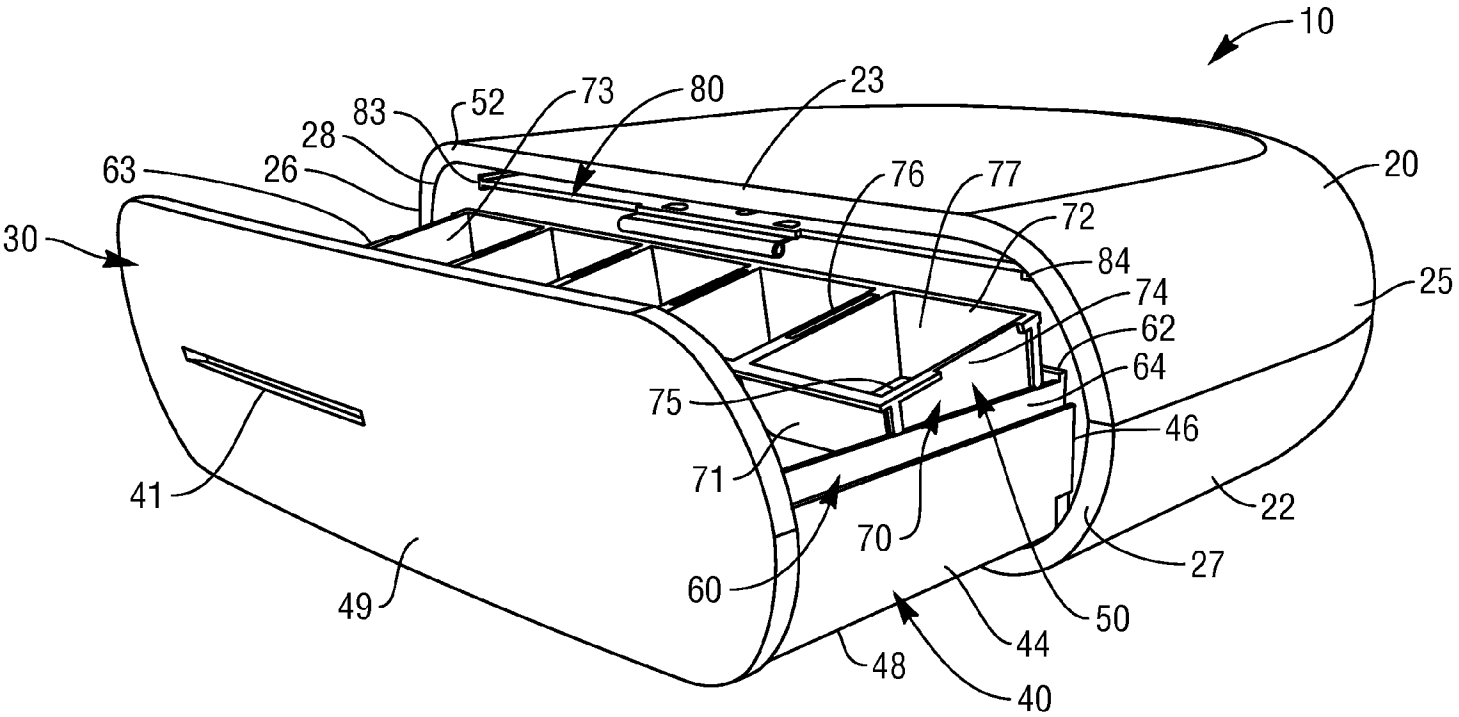
FIG. 2 is a view of the cash drawer of FIG. 1 in an open position.
Figure 3:
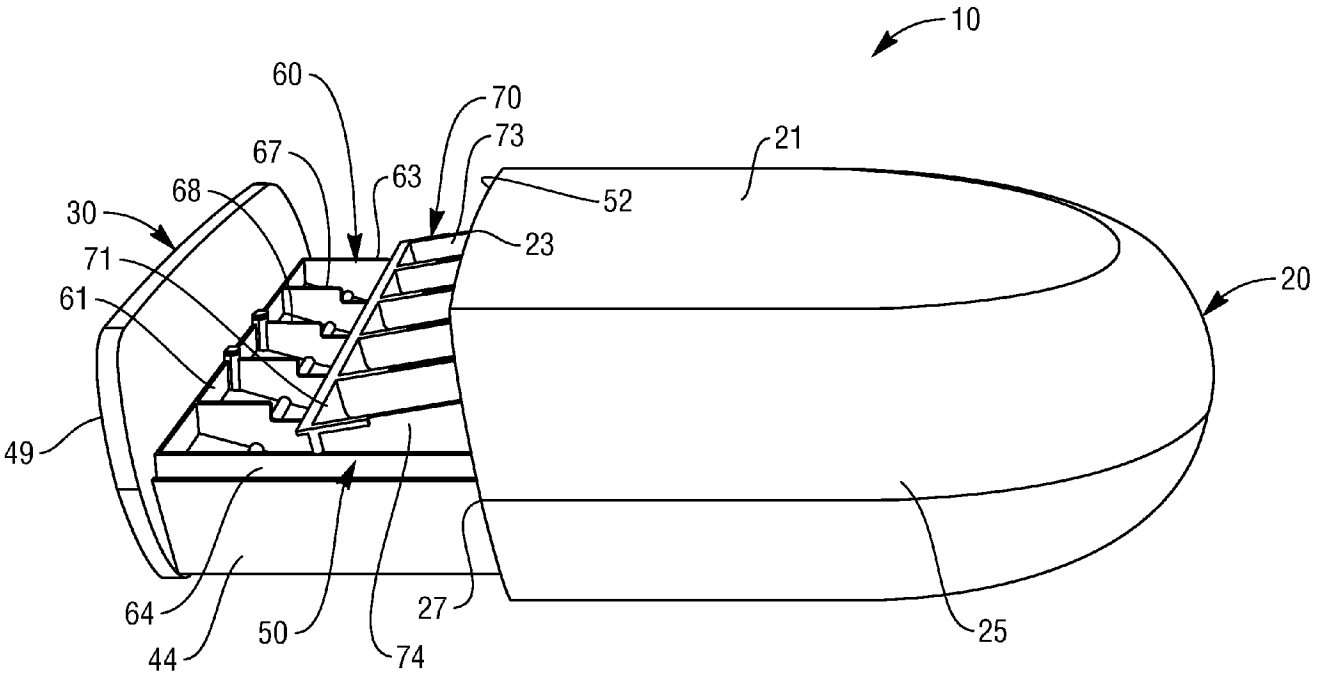
FIG. 3 is another view of the cash drawer of FIG. 1 in an open position.
Figure 4:
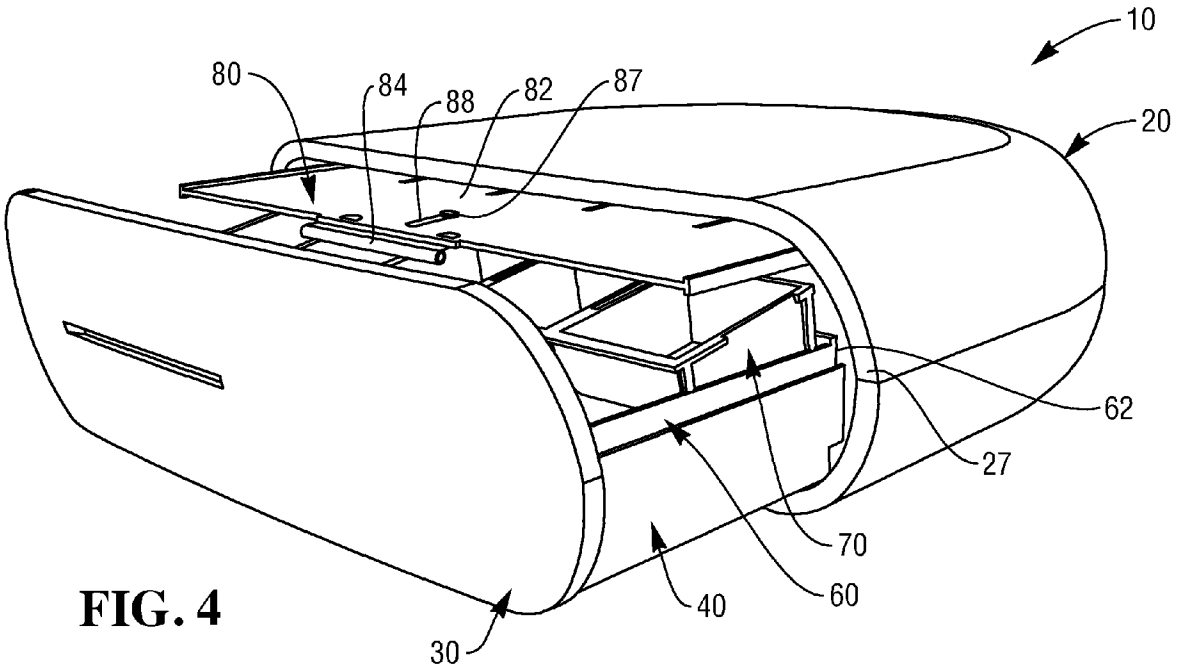
FIG. 4 another view of the cash drawer of FIG. 1 in an open position and with a lid extracted.
Figure 5:
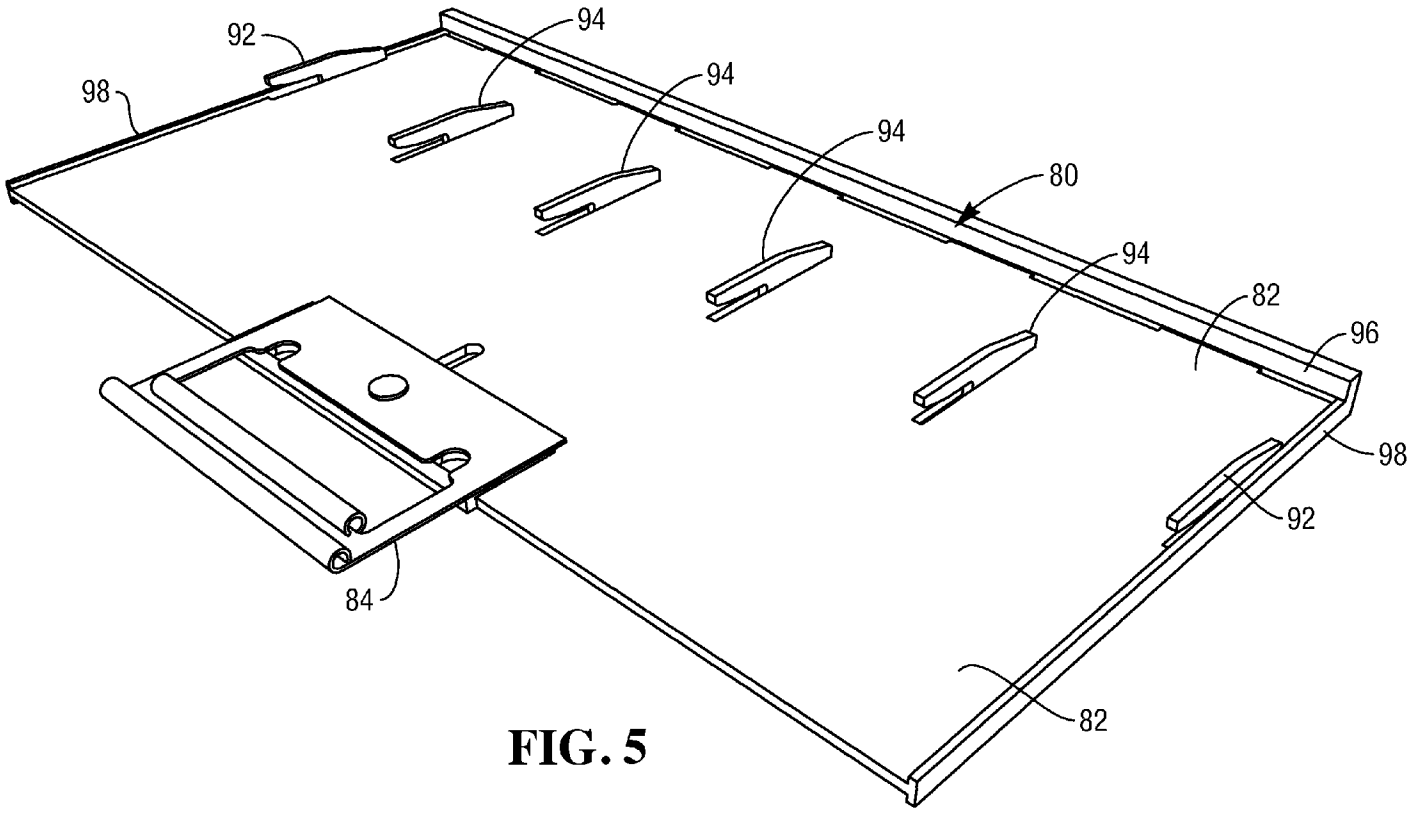
FIG. 5 is a perspective view of the lid.

Beginning with FIGS. 1-3, an example cash drawer 10 is a peripheral which connects to a point-of-sale (POS) terminal 12. Cash drawer 10 and POS terminal 12 include communication circuitry, such as Universal Serial Bus (USB) circuitry for communicating with each other over a cable. POS terminal 12 or its display may be positioned on top of cash drawer 10.

Cash drawer 10 includes housing 20 and drawer assembly 30. With reference to FIG. 1, cash drawer assembly 30 is illustrated in a closed position within housing 20.

Example housing 20 includes generally coplanar top and bottom walls 21 and 22. Top wall has a slightly arcuate front end 23 and bottom wall has a slightly arcuate front end 24 which is recessed with respect to front end 23. The rear portions of top and bottom walls 21 and 22 are generally rounded in shape. A generally arcuate wall 25 links top and bottom walls 21 and 22 and extends around housing 20 from a front end 26 on one side to a front end 27 on the opposite side. The example housing 20 is shorter than the housing of a conventional cash drawer. Other example configurations are also envisioned.

With reference to FIGS. 2-6, drawer assembly 30 is in an open position. Drawer assembly 30 retracts from aperture 28 in housing 20. Drawer assembly 30 includes drawer 40 and till 50. Drawer 40 includes generally planar side walls 44, back wall 46, and bottom wall 48. Drawer 40 further includes front wall 49 containing media slot 41, which is substantially flush with front edge 52 of housing 20 when drawer 40 is in a closed position. Example front edge 52 and corresponding front wall 49 may be generally planar or, as illustrated, have a slightly arcuate shape from front end 26 to front end 27. Front wall 49 is slightly angled towards an operator, as opposed to being vertical, for easier access to bills.

Figure 6:
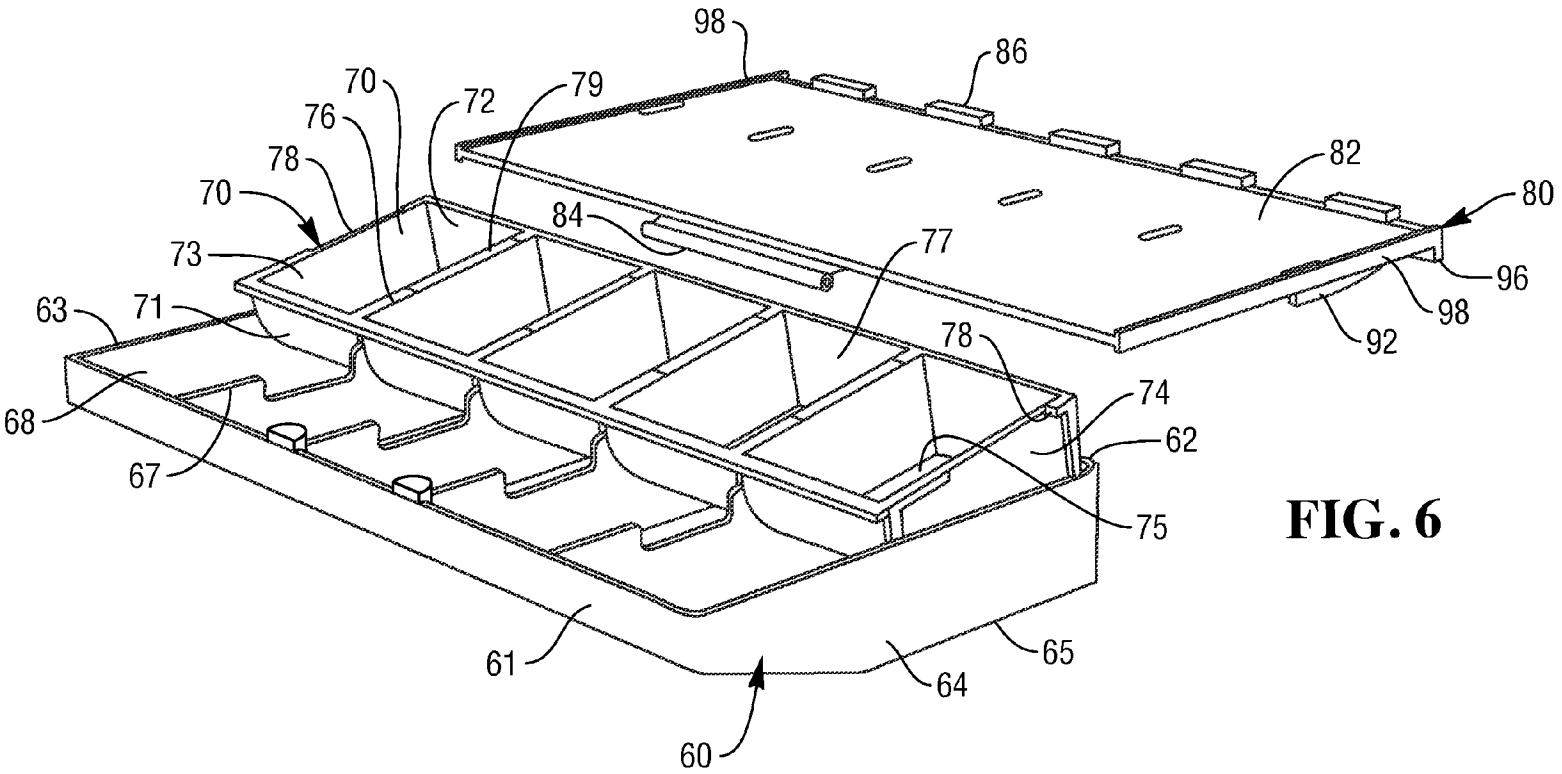
FIGS. 6-11 illustrate assembly of a suitcase from cash drawer components.

Till 50 includes a first tray 60 for storing bank notes and a second tray 70 for storing coins. Tray 60 includes generally planar front, rear, side, and bottom outer walls 61-65. Rear and side walls 63-64 are arranged generally perpendicular to bottom wall 65 (FIG. 6). Bottom wall 65 is sloped at a downward angle from front wall 61 and couples to bottom wall 65. Bottom wall 65 may alternatively have an arcuate slope. Regardless, the downward slope of bottom wall 65 puts bank notes closer to an operator to facilitate easier removal of the bank notes, compared to conventional tills, particularly when reaching near the bottom of tray 60.

Tray 60 further includes interior walls 67 which define compartments 68 having widths about equal to the widths of bank notes stored within tray 60. Compartments 68 may be used to separately store different denominations of bank notes. Interior walls 67 also help properly align second tray 70 on first tray 60 (FIG. 6).

Tray 70 sits above tray 60, instead of behind tray 60. This facilitates a shorter drawer 40 than conventional cash drawers.

Tray 70 includes generally planar front, rear, side, and bottom outer walls 71-75. Side outer walls 73-74 include recesses 78.

Tray 70 further includes interior walls 76 which define compartments 77 having widths about equal to the widths of compartments 68, though other widths and numbers of compartments 77 are also envisioned. Compartments 77 may be used to separately store different denominations of coins. Interior walls 76 include recesses 79.

Front wall 71 is shorter than rear wall 72, thus the top edges of outer side walls 73 and 74 and interior walls 76 are upwardly inclined towards rear wall 72. Front wall 71 is also downwardly sloped away. Front wall 71 may have an arcuate slope. The smaller height and downward slope of front wall 71 result in apertures in the second tray that are inclined towards an operator, thus putting coins closer to the operator to facilitate easier removal of the coins, compared to conventional tills.

Housing 20 also stores lid 80. This reduces the chance of losing or misplacing lid 80. Lid 80 is illustrated in a stored position above drawer 40 on opposite shelves 83 and 84 in housing 20.

Lid 80 includes generally planar member 82 and handle 84.

Figure 8:
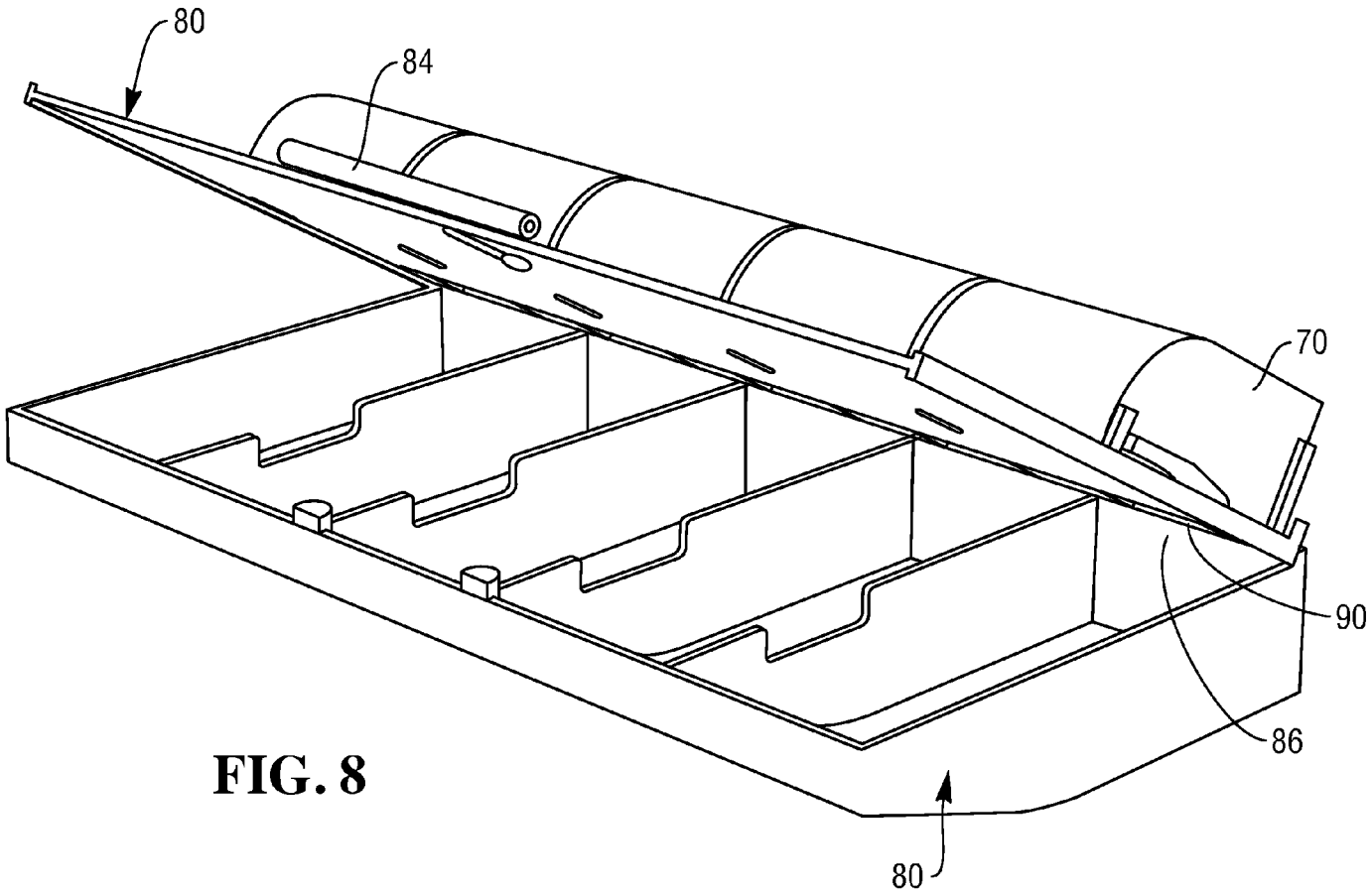

Generally planar member 82 has a length and width similar to the length and width of drawer assembly 30. Generally planar member 82 includes latch members 86 that engage corresponding apertures 90 in tray portion 60 during transport as a suitcase (FIG. 8). Generally planar member 82 further includes latch members 92 (FIG. 6) which engage detents 78 and latch members 94 which engage detents 79 (FIG. 6) during assembly as a suitcase.

Figure 9:
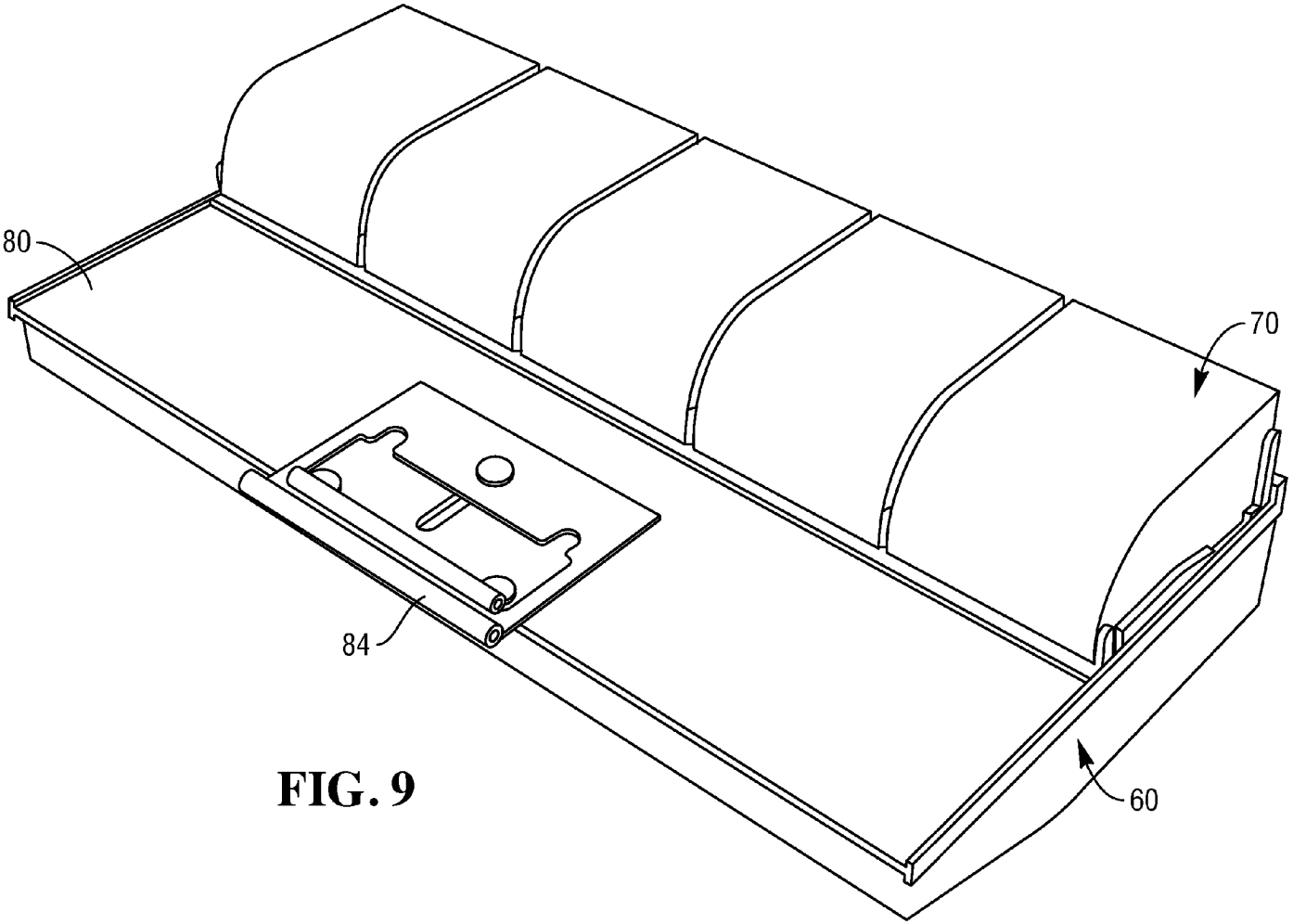

Lid 80 further includes edge member 96 which abuts tray portion 70 during assembly as a suitcase (FIG. 7) and left and right edge members 98 which abut side walls 63 and 64 of tray portion 60 during assembly as a suitcase (FIG. 9).

Figure 10:
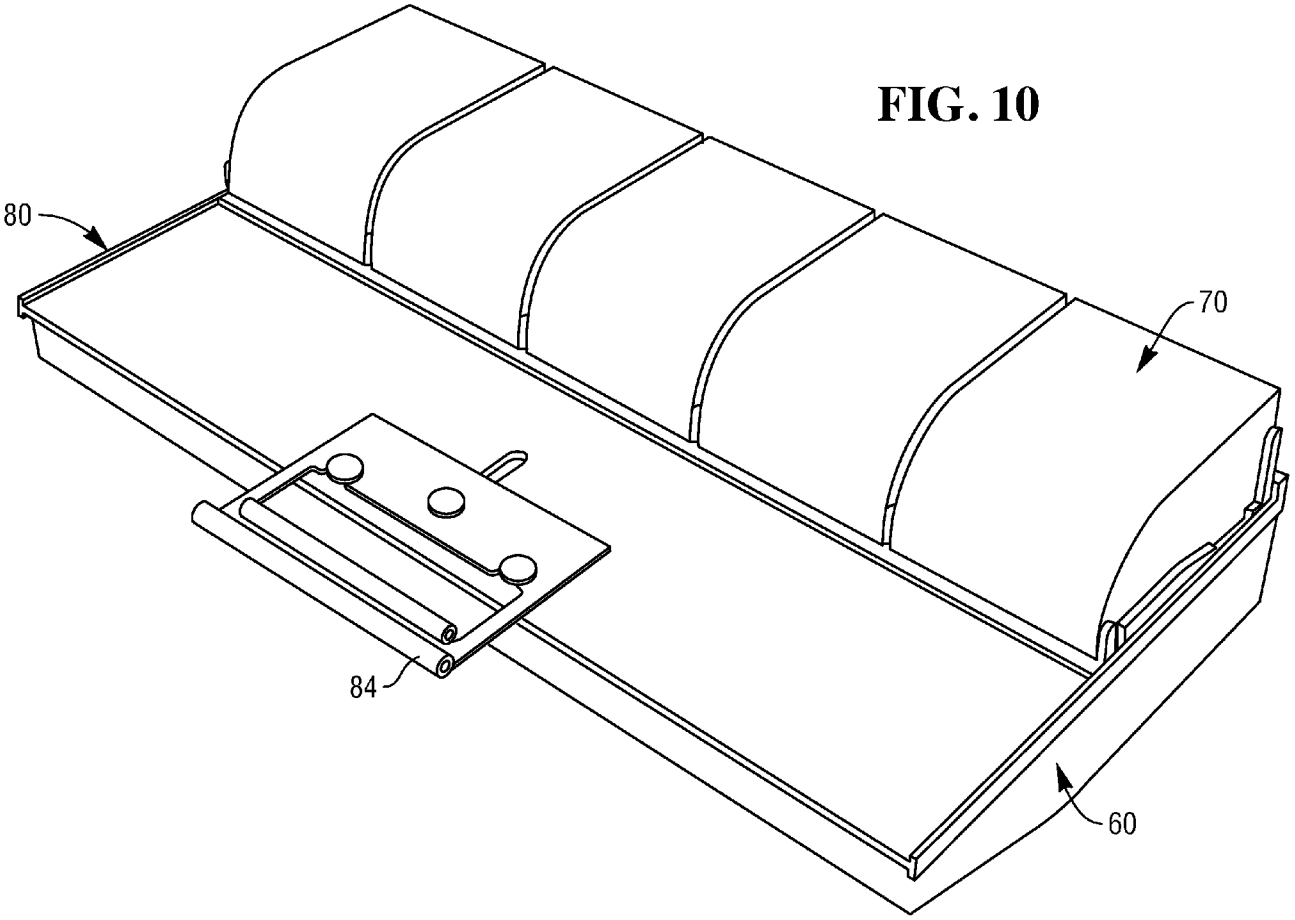

Handle 84 attaches to generally planar member 82 with a rivet 87 or other fastener. Rivet 87 is located with a linear slot 88, which facilitates movement of handle 84 from a retracted position to an extended recessed position for use and back again for storage (FIGS. 9 and 10). Lid 80 may be retracted from housing 20 by pulling on handle 84.

With reference to FIG. 6-11, assembly of a cash "suitcase" is illustrated. In FIG. 6, till 50 is removed from drawer 40 and lid 80 is removed from housing 20. An operator removes lid using handle 84 and latch members 92-94 facing till 50. Latch members 92-94 hold tray portion 60 firmly to reduce warp/gap that may otherwise cause coins to slip out. Lid 80 is stored such that it can directly latch onto tray 70 without being flipped around.

Figure 7:
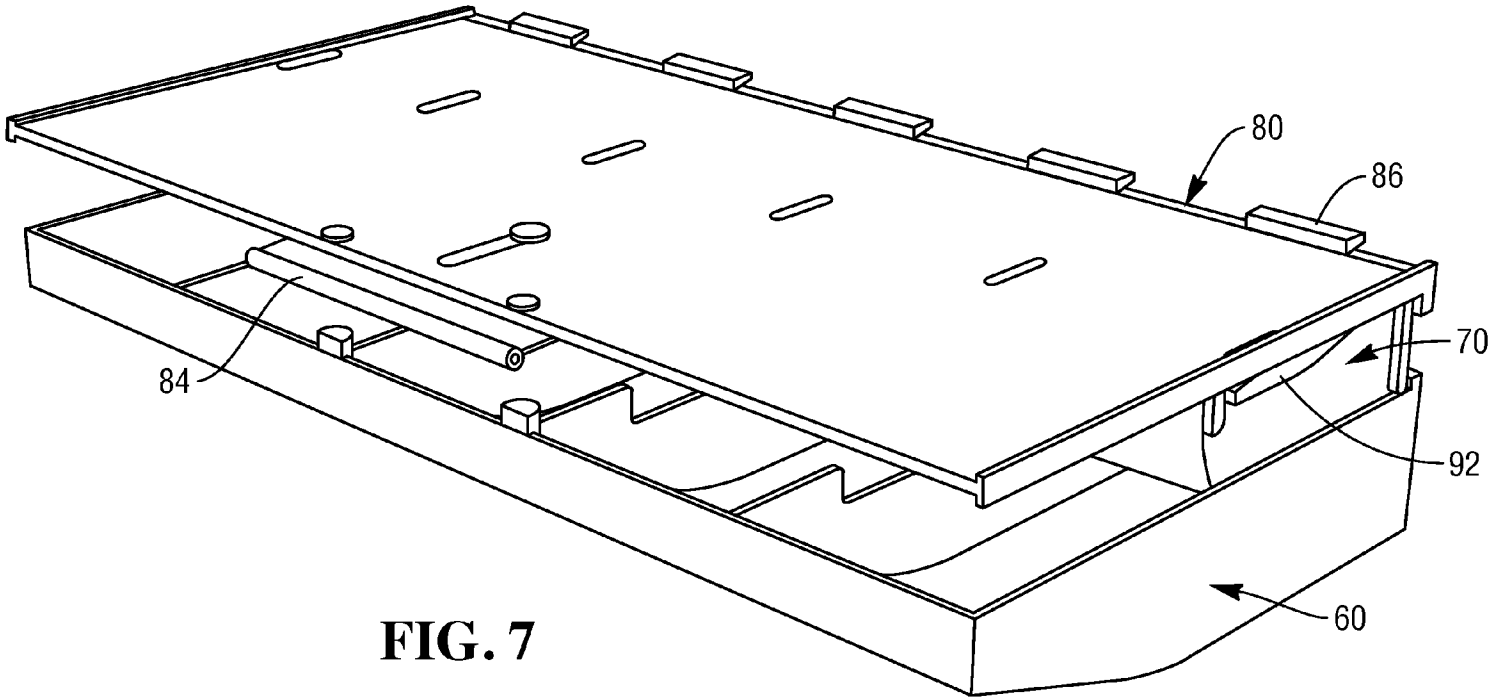

In FIG. 7, lid 80 is attached to tray 70 by inserting latching members 92 into detents 78 and latch members 94 into detents 79.

In FIG. 8, lid 80 with tray 70 attached is flipped so that handle 84 and tray 70 facing away from tray 60. Latching members 86 engage corresponding apertures 90 in tray 60.

In FIG. 9, lid 80 is closed on tray 60.

In FIG. 10, handle 84 is extended from a retracted position to an extended recessed position for use.

Figure 11:
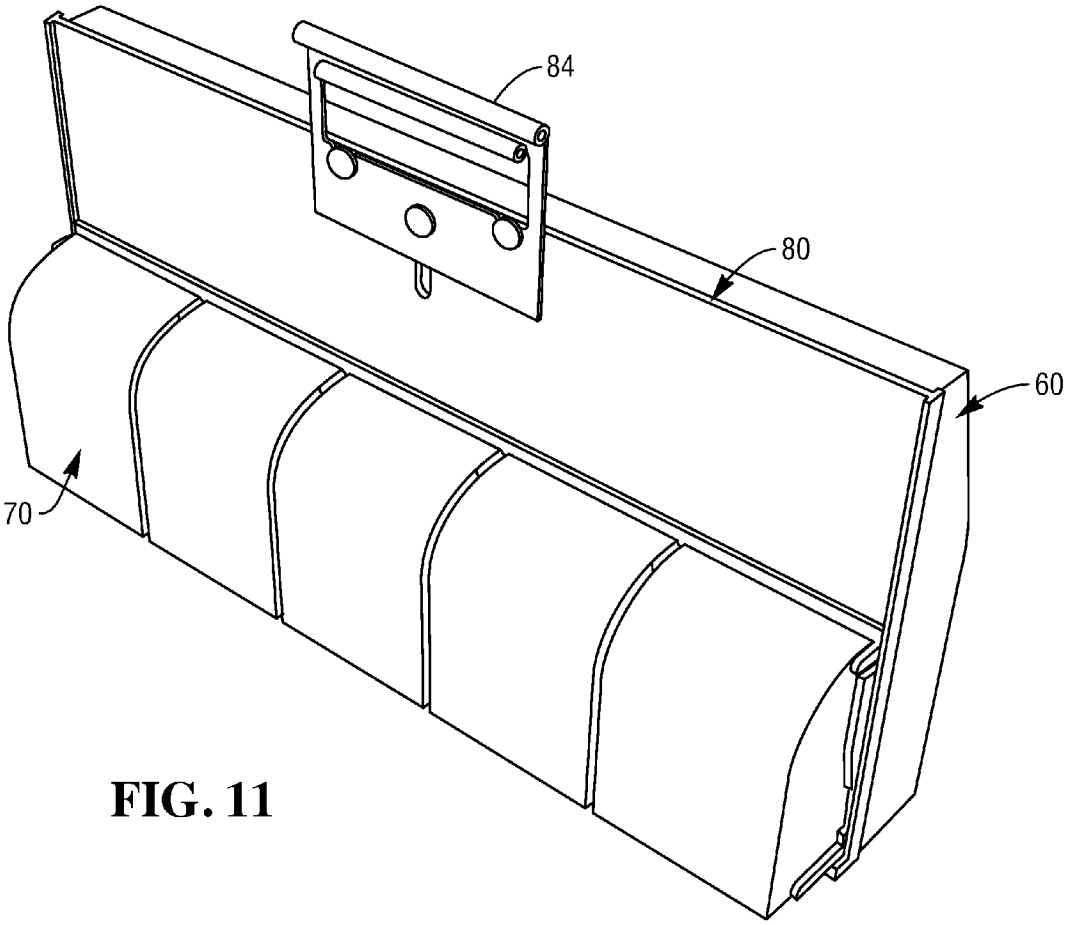

In FIG. 11, the combination of till 50 and lid 80 are positioned to be carried like a suitcase.

Cash drawer 10 is more ergonomic than conventional cash drawers. Drawer 40 is shorter to no longer require a cashier to step back when the drawer 40 is in an open position. The downward slope of bottom wall 65 puts bank notes closer to an operator to facilitate easier removal of the bank notes. Front wall 49 of drawer assembly 30 is slightly angled towards an operator for easier access to bills. Finally, lid 80 is integrated into housing 20 to avoid misplacing it. Till 50 and lid 80 are easily combined to form a suitcase for ease of transport.

Although the present invention has been described with particular reference to certain preferred embodiments thereof, variations and modifications of the present invention can be effected within the spirit and scope of the following claims.

What is claimed is:

1. A cash drawer comprising:

a housing having an operator side; and a drawer assembly moveable from a closed position in the housing to an open position;

wherein the drawer assembly includes a drawer, a first tray in the drawer for storing bank notes, a second tray in the first tray for storing coins, and a lid, wherein the housing completely surrounds the drawer and rounded in shape, and wherein the lid is oriented above the drawer on shelves within the housing, and wherein the lid includes a handle affixed to the lid by a fastener located within a linear slot of the lid for movement of the handle on the lid from a retracted position to an extended recessed position.

2. The cash drawer of claim 1, wherein the first tray comprises a bottom wall having a generally downward slope away from the operator side.

3. The cash drawer of claim 1, wherein the second tray includes a plurality of apertures inclined towards the operator side.

4. The cash drawer of claim 1, wherein the first and second trays are removable, the cash drawing further comprising:

The lid removable from the housing including a first side for enclosing the first tray and a second side for enclosing the second tray.

5. The cash drawer of claim 1, wherein the drawer assembly further includes a front wall coupled to the drawer at the operator side at an angle.

6. A cash drawer comprising:

a housing having an operator side;

a drawer assembly moveable from a closed position in the housing to an open position; and a retractable handle affixed to an underside portion of a lid for the drawer;

wherein the drawer assembly includes a drawer and a front wall coupled to the drawer at the operator side and at an angle, and wherein the lid is oriented above the drawer within the housing and included on shelves within the housing, and wherein the lid includes a handle affixed to the lid by a fastener located within a linear slot of the lid for movement of the handle on the lid from a retracted position to an extended recessed position.

7. The cash drawer of claim 6, wherein the drawer assembly further comprises a till including a bottom wall having a generally downward slope away from the operator side.

8. The cash drawer of claim 7, wherein the till comprises a first tray for storing bank notes and a second tray for storing coins, wherein the second tray sits within the first tray.

9. The cash drawer of claim 8, wherein the second tray includes a plurality of apertures inclined towards the operator side.

10. The cash drawer of claim 6, further comprising:

a till removable from the drawer; and the lid to enclose the till for transport.

11. The cash drawer of claim 10, wherein the till comprises a first tray for storing bank notes and a second tray for storing coins, wherein the lid includes a first side for enclosing the first tray and a second side for enclosing the second tray.

12. The cash drawer of claim 6, wherein the lid rotatably couples to the first tray.

* * * * *